United States Patent [19]

Matsuura et al.

[11] Patent Number: 4,633,841

[45] Date of Patent: Jan. 6, 1987

[54] AIR-FUEL RATIO CONTROL FOR AN INTERNATIONAL COMBUSTION ENGINE

[75] Inventors: Masahiko Matsuura; Tadashi Kaneko; Tadayoshi Kaide; Makoto Hotate, all of Hiroshima, Japan

[73] Assignee: Mazda Motor Corporation, Hiroshima, Japan

[21] Appl. No.: 769,390

[22] Filed: Aug. 26, 1985

[30] Foreign Application Priority Data

Aug. 29, 1984 [JP] Japan ..... 59-178424

[51] Int. Cl.[4] ..... F02D 41/04; F02D 41/26

[52] U.S. Cl. ..... 123/492; 123/493; 123/478

[58] Field of Search ..... 123/438, 440, 478, 480, 123/489, 492, 493

[56] References Cited

U.S. PATENT DOCUMENTS 4,487,190 12/1984 Isobe ..... 123/492
4,512,318 4/1985 Ito et al. ..... 123/492
4,520,783 6/1985 Matsushita et al. ..... 123/492
4,548,181 10/1985 Ishikawa et al. ..... 123/492

FOREIGN PATENT DOCUMENTS 0105530 7/1982 Japan .
0072631 4/1983 Japan .

*Primary Examiner*—Willis R. Wolfe, Jr.
*Attorney, Agent, or Firm*—Fleit, Jacobson, Cohn & Price

[57] ABSTRACT

An engine air-fuel ratio control system in which the engine operating range is divided into a light load, medium load and heavy load regions. In the light load region, a control of the fuel supply is made so as to provide a mixture of leaner than the stoichiometric value. In the medium load region, a feedback control is made based on the signal from an $O_2$ sensor and, in the heavy load region, a control is made to provide a richer mixture. In the transient between the light load and medium load regions, the air-fuel ratio is changed with a rate which changes in accordance with the rate of change in the engine load.

10 Claims, 8 Drawing Figures

AIR-FUEL RATIO CONTROL FOR AN INTERNATIONAL COMBUSTION ENGINE

BACKGROUND OF THE INVENTION

1. Field of the Invention

The present invention relates to a control for an internal combustion engine and, more particularly, to an air-fuel ratio control for an engine.

2. Description of Prior Art

In internal combustion engines, particularly in engines of electronically controlled fuel injection type, engine operating conditions, such as engine loads and engine speeds, are classified into a plurality of regions wherein fuel supply is controlled such that different air-fuel ratios are established among different regions. For example, in Japanese patent application No. 56-170949 filed on Oct. 26, 1981 and disclosed for public inspection of Apr. 30, 1981 under the disclosure no. 58-72631, there is disclosed an engine air-fuel ratio control system wherein the engine operating range is divided into a high speed, heavy load region and a low speed, light load region and the fuel supply is controlled in the high speed, heavy load region under the feedback signal from a $O_2$ sensor provided in the exhaust system so that a stoichiometric air-fuel ratio can be established. The low speed, light load region is further divided into a plurality of sub-regions and the fuel supply is controlled in the sub-regions so that an air-fuel mixture leaner than the stoichiometric ratio is established. According to the teachings in the Japanese patent application, the fuel supply control is such that the leanest mixture is produced in the sub-region which is furthermost from the high speed, heavy load region and the mixture is made gradually closer to the stoichiometric value in the regions closer to the high speed, heavy load region.

The control system disclosed in the Japanese patent application is considered as desirable in that an abrupt change in the air-fuel ratio can be avoided between the high speed, heavy load region and the low speed, light load region. It should however be noted that the system is not satisfactory because a sufficiently lean mixture cannot be produced in the sub-region adjacent to the high speed, heavy load region so that a sufficient improvement cannot be achieved in fuel economy. In Japanese patent application No. 55-181210 filed on Dec. 23, 1980 and disclosed for public inspection on July 1, 1982 under the disclosure no. 57-105530, there is disclosed a control system wherein the air-fuel ratio is changed at a constant rate when the engine operating condition is changed from the high speed, heavy load region to the low speed, light load region, and vice versa. In this control system, it will not be necessary to divide the low speed, light load region into a plurality of sub-regions so that it may be possible to improve the fuel ecomomy. It should however be noted that, since the air-fuel ratio is changed at a constant rate, the air-fuel ratio cannot always be controlled as desired. For example, when the engine throttle valve is opened for acceleration in the low speed, light load region, the air-fuel ratio may not be enriched rapidly so that the operator may feel lack of engine power.

SUMMARY OF THE INVENTION

It is therefore an object of the present invention to provide an engine control system in which air-fuel ratio is changed depending on the engine operating condition to meet the demand of the operator.

Another object of the present invention is to provide an engine air-fuel ratio control system in which the air-fuel ratio is determined in accordance with the engine operating condition and a change in the air-fuel ratio is made with a rate which is controlled in accordance with the engine operating condition.

A further object of the present invention is to provide an engine air-fuel ratio control system which can accomplished a further improvement in fuel economy.

The present invention is characterized by the fact that the air-fuel ratio is changed, when the engine operating condition is shifted from one region to another, with a rate of change which is dependent on the rate of change in the load on the engine. The present invention is based on the recognition of the fact that the operator's intention is most appropriately grasped by the load on the engine. Thus, the rate of change in the air-fuel ratio is increased in response to an increase in the rate of change in the engine load. The engine load can be detected for example in terms of the throttle valve position or the intake pressure.

According to the present invention, there is therefore provided an engine air-fuel ratio control system for controlling air-fuel ratio of a mixture to be supplied to the engine to at least two different values depending on engine operating conditions, said system including engine operating condition detecting means for detecting the engine operating condition to produce an engine operating condition signal, air-fuel ratio setting means responsive to the engine operating condition signal for setting one of the values of the air-fuel ratio depending on the engine operating condition, engine load change rate detecting means for detecting a rate of change in load on the engine and producing a load change rate signal, air-fuel ratio change rate setting means responsive to said load change rate signal to determine a rate of change in the air-fuel ratio, when the air-fuel ratio is to be changed from one value to another, in accordance with the rate of change in the engine load so that the rate of change in the air-fuel ratio is increased as the rate of change in the engine load increases.

According to one aspect of the present invention, the control system includes air-fuel ratio control means for providing a first air-fuel ratio in a first region of engine operating condition and a second air-fuel ratio in a second region of engine operating condition, engine operating condition detecting means for producing an engine operating condition signal which is applied to said air-fuel ratio control means to make the air-fuel ratio control means output a signal corresponding to one of the first and second air-fuel ratios depending on the engine operating condition, engine load change rate detecting means for detecting a rate of change in load on the engine and producing a load change rate signal, air-fuel ratio changing means responsive to said load change rate signal to determine a rate of change in the air-fuel ratio, when the engine operating condition changes between said first and second regions, in accordance with the rate of change in the engine load so that the rate of change in the air-fuel ratio is increased as the rate of change in the engine load increases.

According to the present invention, since the rate of change of the air-fuel ratio is increased as the rate of change of the engine load increases, the engine output can be controlled with a satisfactorily responsive characteristics under the intention of the operator. When the rate of change of the engine load is small, the rate of change of the air-fuel ratio is small so that there will be no significant change in the engine output torque. The above and other objects and features of the present invention will become apparent from the following descriptions of a preferred embodiment taking reference to the accompanying drawings.

DESCRIPTION OF THE PREFERRED EMBODIMENT

Figure 1:
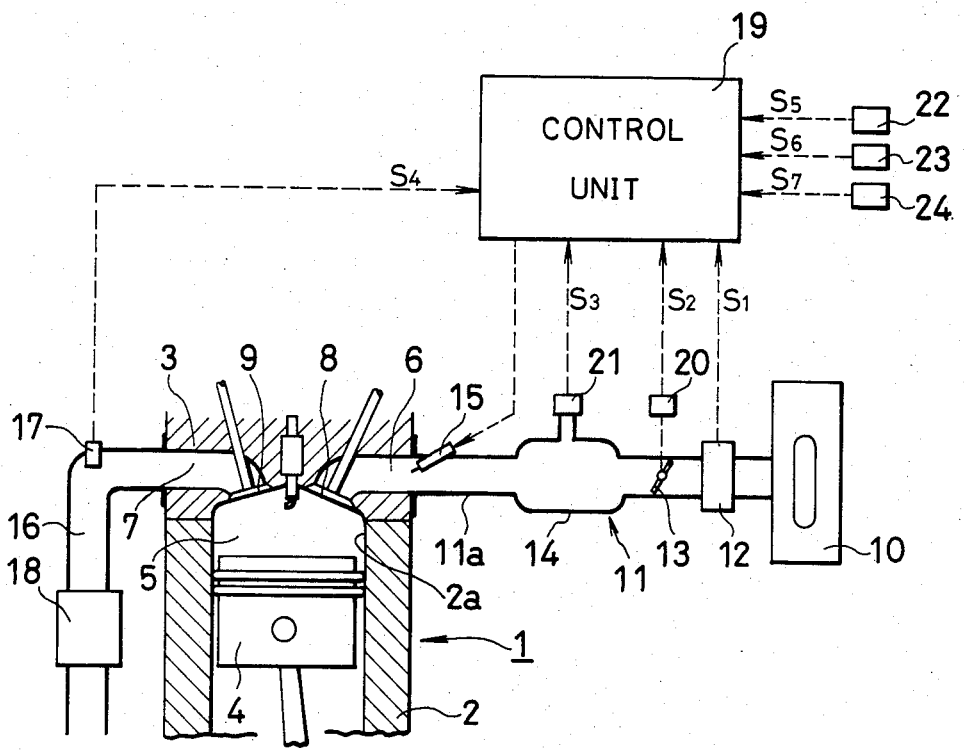
FIG. 1 is a sectional view of an engine having a control system in accordance with the present invention.

Referring now to the drawings, particularly to FIG. 1, there is shown an engine 1 including a cylinder block 2 having a cylinder bore 2*a* and a cylinder head 3 attached to the top land of the cylinder block 2. A piston 4 is disposed in the cylinder bore 2*a* for reciprocating movements therein. The cylinder block 2, the cylinder head 3 and the piston 4 define a combustion chamber 5. The cylinder head 3 is formed with an intake port 6 and an exhaust port 7. An intake port 8 and an exhaust port 9 are respectively provided in the intake port 6 and the exhaust port 7 to open the ports at appropriate timings as well known in the art.

The intake port 6 is connected with an intake passage 11 which has an air cleaner 10 at the upstream end. In the intake passage 11, there is a throttle valve 13 downstream the air cleaner 10, and an airflow detector 12 is provided between the air cleaner 10 and the throttle valve 13. The intake passage 11 is further has a surge tank 14 formed downstream the throttle valve 13 and a fuel injection valve 15 is located in the vicinity of the intake port 6. In case of a multiple cylinder engine, the surge tank 14 may be common for all cylinders but the passage 11*a* downstream the surge tank 14 is provided one for each cylinder. Therefore, the fuel injection valve 15 is provided for each cylinder. The exhaust passage 16 is provided with an $O_2$ sensor 17 and a catalylic device 18 which are located in this order from the upstream side.

In order to control the fuel supply through the fuel injection valve 15, the engine 1 is provided with a control unit 19 which may be a microprocessor. The control unit 19 has an input connected with the airflow detector 12 to receive an airflow signal $S_1$ therefrom. The throttle valve 13 is provided with a throttle position sensor 20 for producing a throttle position signal $S_2$ which is applied to the control unit 19. In the surge tank 14, there is a suction pressure sensor 21 for producing a suction pressure signal $S_3$ which is also applied to the control unit 19. Further, the control unit 19 is connected with the $O_2$ sensor 17 for receiving an $O_2$ signal $S_4$ therefrom. The engine 1 is further provided with an engine speed sensor 22 for producing a speed signal $S_5$, and a cooling water temperature sensor 23 for producing a cooling water temperature signal $S_6$, and these signals $S_5$ and $S_6$ are also applied to the control unit 19. The control unit 19 further receives an ignition signal $S_7$ from an engine ignition switch 24 for judging that the engine is in operation. The control unit 19 performs calculations based on the aforementioned input signals and produces an output in the form of control pulses which are applied to the fuel injection valve 5 to energize it.

The operation of the control unit 19 will now be described taking reference to FIGS. 2 through 8. The control is based on the duty factor type wherein the quantity of fuel supply is determined by the durations of the output pulses from the control unit 19. The control unit 19 has a control map as shown in FIG. 3. In the control map, the engine operating range as defined by the engine load and the engine speed is divided into three regions A, B and C. The region A may be referred to as a lean region wherein the engine is operated with an air-fuel mixture leaner than the stoichiometric value. The region A of course includes the idling operation. The region B is feedback region wherein the fuel supply is controlled in accordance with the $O_2$ signal $S_4$ from the sensor 17 so that the air-fuel ratio of stoichiometric value is established. Under the engine cooling water temperature lower than 50° C., the feedback control is carried out even in the region A. The region C is a rich region wherein the air-fuel mixture is richer than the stoichiometric value for producing a high output to meet the heavy load operation. In the embodiment, the concept of the present invention is applied to the air-fuel ratio control in the transient period between the regions A and B.

Figure 2:
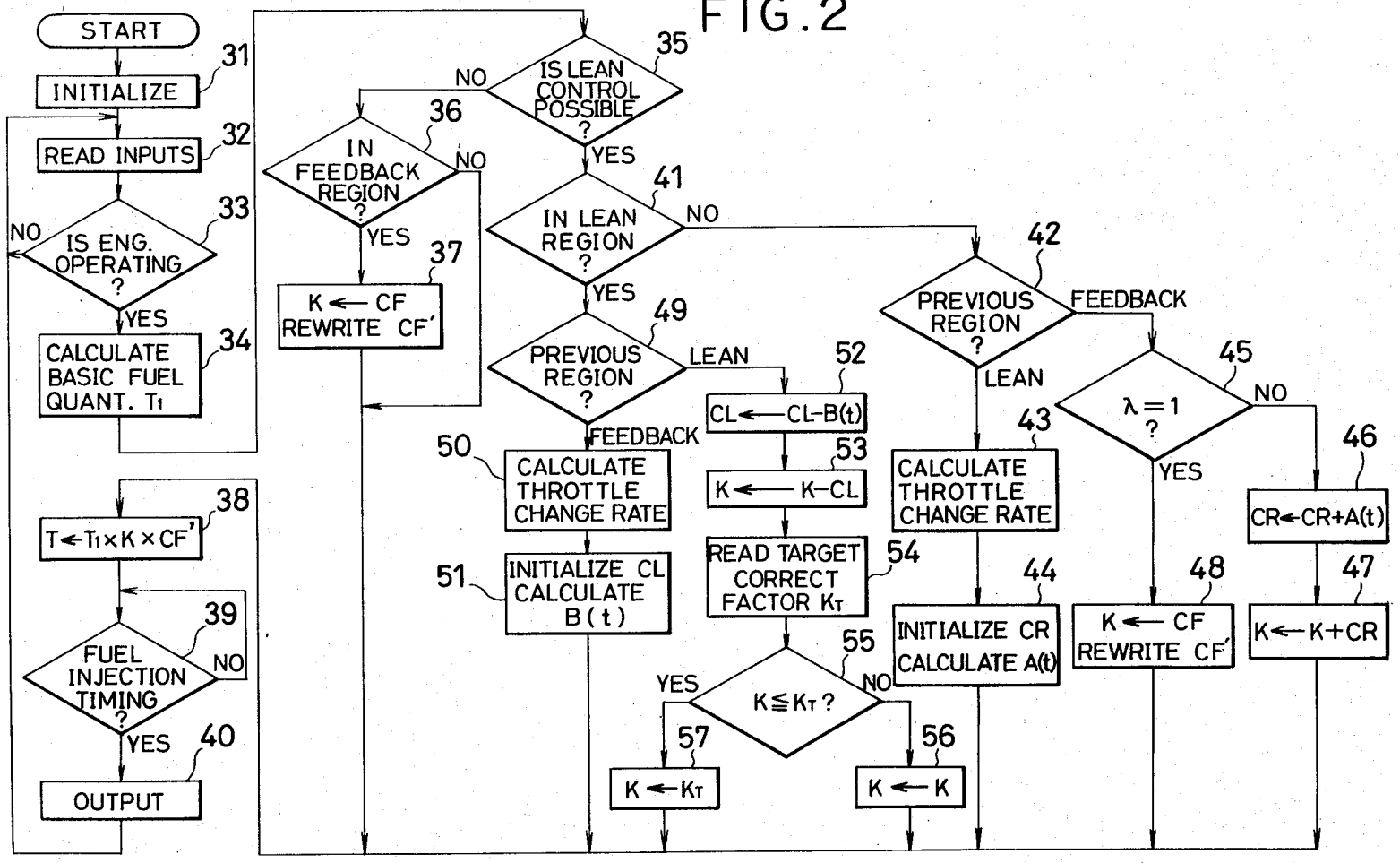
FIG. 2 is a program flow chart showing the operation of the control unit.
Figure 3:
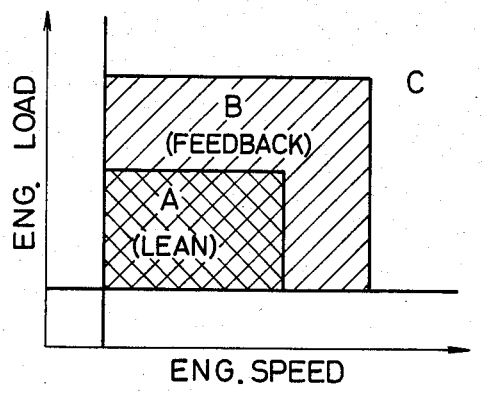
FIG. 3 is an example of an air-fuel ratio control map used for the operation of the control unit.

Referring now to FIG. 2, the unit 19 is initialized in step 31 and the input signals $S_1$ through $S_7$ are read in step 32. Then, a judgement is made in step 33 as to whether the engine is in operation. This judgement is made on the basis of the ignition signal $S_7$ from the ignition switch 24. If the result of judgement in NO, the step 32 is repeated. If the result of the judgement is YES, a calculation is made in step 34 to obtain a basic fuel quantity $T_1$. The calculation is made based on the signals relating to the engine operating condition, such as the engine speed signal $S_5$ and the throttle valve position signal $S_2$ so that an air-fuel mixture of stoichiometric value is theoretically obtained. Thereafter, a judgement is made in step 35 as to whether the engine is capable of being operated with a lean mixture. The judgement is made based on the temperature signal $S_6$ and it is judged that the engine can be operated with a lean engine when the engine cooling water temperature is above 50° C. When it is judged that the engine temperature is too low for the lean mixture operation, the step 36 is carried out. In the step 36, a judgement is made as to whether the engine operating condition is in the feedback region B. If the result of judgement in the step 36 is YES, a feedback correction factor CF is stored in step 37 as the final correction factor K. At the same time, the previous learning factor CF' is rewritten by the correction factor CF, and the step 38 is then carried out. When the judgement in the step 36 is NO, the step 38 is carried out without going through the step 37. In the step 38, a calculation is made to obtain a fuel supply quantity T based on the basic fuel quantity $T_1$, the final correction factor K and the learning factor CF' in the accordance with a formula $T=T_1\times K\times CF'$.

Thereafter, a judgement is made in step 39 as to whether the fuel injection shall be carried out. When the result of the judgement is YES, the output pulse is produced in step 40.

The correction of the fuel supply quantity based on the learning factor CF' in the step 38 is made for the purpose of correcting the basic fuel quantity $T_1$ so that the actual fuel supply matches the actual model to obtain an optimum air-fuel ratio. The learning factor CF' is obtained during the feedback control based on the $O_2$ signal $S_4$ from the $O_2$ sensor 17. Since the learning factor CF' should preferably be a newest one, the factor CF' is rewritten in the step 37. The rewriting procedure for the learning factor CF' is described in detail in the Japanese patent disclosure No. 57-105530 so that a further description will not be made.

Figure 7:
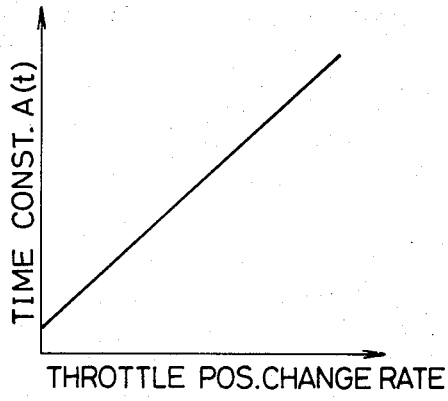
FIGS. 7 and 8 are diagrams showing the factors for determining the rate of change in the air-fuel ratio.

When the judgement in the step 35 is YES, a further judgement is made in step 41 as to whether the engine operating condition is in the lean region. When the answer is NO, it is judged that the engine operating condition is in the feedback region and a further judgement is made in step 42 as to whether the engine operating condition in the previous cycle was in the feedback region or in the lean region. When the answer is "lean region", it is judged that the engine operating condition has been changed from the lean region to the feedback region and a calculation is made in step 43 to obtain the rate of change of the throttle valve position. For the purpose, the change in the throttle valve position may be differentiated by time. Therefore, the air-fuel ratio change rate factor CR is initialized in step 44 and a calculation is made to obtain a time constant A(t) as shown in FIG. 7 in accordance with the rate of change of the throttle valve position. Then, the step 38 is carried out.

When the answer in the step 42 is "feedback region", the step 45 is carried out. In the step 45, a judgement is made based on the $O_2$ signal $S_4$ as to whether the air-fuel ratio is at the stoichiometric value, or in other words, as to whether the air excess rate $\lambda$ is 1 or not. If the result of the judgement is NO, the process proceeds to the step 46 wherein the factor CR is rewritten in accordance with a formula $CR \leftarrow CR + A(t)$. Then, the step 47 is carried out to calculate the final correction factor K in accordance with a formula $K \leftarrow K + CR$ using the newly obtained value CR. Thereafter, the process is proceeded to the step 38. By repeating the steps 45 through 47, the air-fuel mixture is stepwisely enriched until the air excess rate $\lambda$ becomes 1. When the air excess rate $\lambda$ becomes 1, the process proceeds from the step 45 to the step 48 wherein the feedback correction factor CF based on the $O_2$ signal $S_4$ is stored as the final correction factor K and the learning factor CF' is rewritten by the factor CF.

Figure 4:
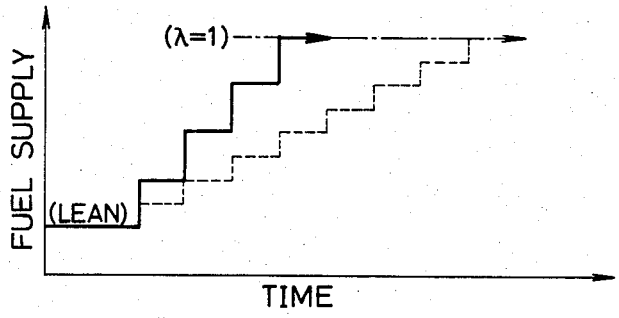
FIG. 4 is a diagram showing examples of changing the air-fuel ratio from a lean mixture to a rich mixture.

From the above descriptions, it will be understood that, at the instance when the engine operating condition changes from the lean region A to the feedback region B, the steps 42, 43 and 44 are carried out to determine the time constant A(t) in accordance with the rate of change in the throttle valve position. Thereafter, the steps 42, 45, 46 and 47 are carried out repeatedly to stepwisely enrich the air-fuel mixture with the rate of change as determined by the time constant A(t). After the air-fuel mixture is enriched so that the air excess rate $\lambda$ becomes 1, the steps 42, 45 and 48 are carried out to perform the feedback control. The change in the air-fuel ratio is shown in FIG. 4 in which the solid line shows the change in the air-fuel ratio when the rate of change in the throttle position is large but the broken line shows the change in the air-fuel ratio when the rate of change in the throttle position is small. The rate of change of the air-fuel ratio is determined by the time constant A(t) which is in turn determined in accordance with the rate of change in the throttle valve position as shown in FIG. 7.

When the engine operating condition shifts from the feedback region B to the lean region A, the answer in the step 41 is YES so that the process proceeds to step 49 wherein a judgement is made as to whether the engine operating condition in the previous cycle was in the lean region or in the feedback region. When the answer is "feedback region", it is judged that the operating condition has been shifted from the feedback region to the lean region and the process is proceeded to the step 50 wherein a calculation is carried out to obtain the rate of change in the throttle valve position. Thereafter, the air-fuel ratio change rate CL is initialized and a time constant B(t) is calculated in step 51 based on the diagram shown in FIG. 8. Then, the process is proceeded to the step 38. In the next cycle, the answer in the step 49 becomes "lean region" so that the process is proceeded to step 52 wherein the air-fuel ratio change rate CL is calculated by a formula $CL \leftarrow CL - B(t)$. Then, the step 53 is carried out to perform a calculation based on a formula $K \leftarrow K - CL$ to obtain the final correction factor K. Then, a target correction factor KT is read in step 54. The target correction factor KT is a valve which is in advance determined for obtaining a desired air-fuel ratio which is leaner than the stoichiometric value. Thereafter, a judgement is made in step 55 as to whether the value KT is not smaller than the value K. If the judgement is that the value KT is smaller than the value K, it is judged that the correction factor K is not sufficient to accomplish the desired lean mixture so that the value K is maintained in step 56 and the process 38 is thereafter carried out. By repeating the steps 49, 52, 53, 54, 55 and 56, the value K is gradually decreased and finally becomes equal to or larger than the value KT. Then, the step 57 is carried out to adopt the value KT as the final correction factor K to perform the engine operation with the desired lean mixture.

Figure 5:
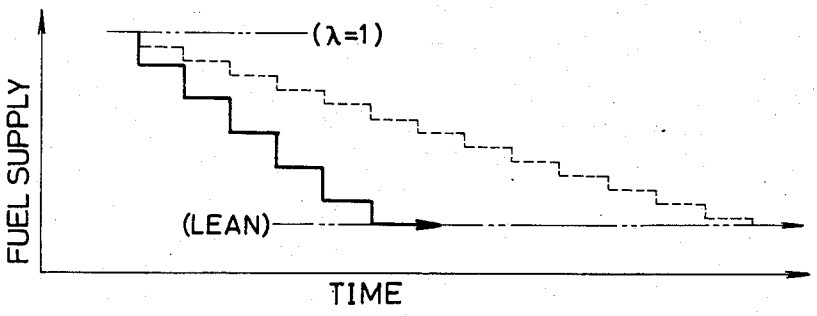
FIG. 5 is a diagram showing examples of changing the air-fuel ratio from a rich mixture to a lean mixture.
Figure 8:
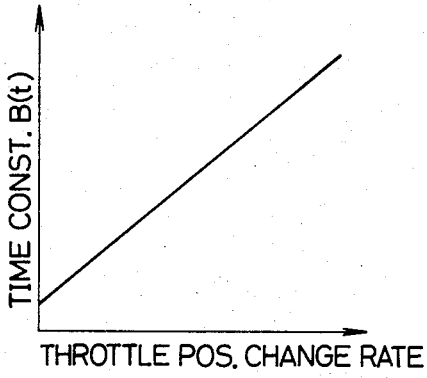

It will be understood that the steps 49, 50 and 51 are carried out at the instance when the engine operating condition is shifted from the feedback region to the lean region and thereafter the steps 49, 52, 53, 54, 55 and 56 are carried out to stepwisely make the air-fuel mixture leaner until a desired lean mixture is obtained. When the desired lean mixture is obtained, the steps 49, 52, 53, 54, 55 and 57 are carried out. The change in the air-fuel ratio is shown in FIG. 5 wherein the solid line shows a change in the air-fuel ratio when the rate of change in the throttle valve position is large but the broken line shows a change when the rate of change in the throttle valve position is small. The rate of change in the air-fuel ratio is determined by the time constant B(t) which is in turn determined by the rate of change in the throttle valve position as shown in FIG. 8.

Figure 6:
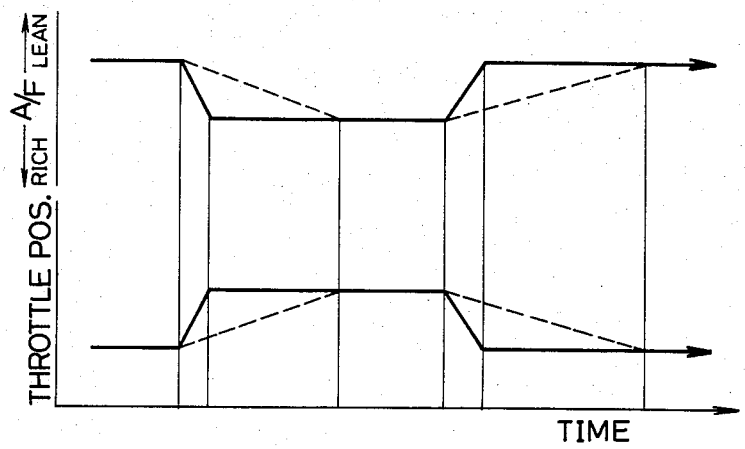
FIG. 6 is a diagram showing the relationships between changes in the engine throttle valve position and the air-fuel ratio.

In the illustrated embodiment, the rate of change of the air-fuel ratio is greater when the engine operating condition is shifted from the lean region to the feedback region than when shifted in the reverse direction under the same rate of change in the throttle valve position. This is because the fact that, when the engine operating condition is shifted from the lean to feedback region, there is a tendency that the increase in fuel supply is delayed so that a leaner mixture is apt to be produced than desired. FIG. 6 shows examples of the relationship between the movements of the throttle valve and the changes in the air-fuel ratio. In FIG. 6, the solid line for the throttle valve position corresponds to the solid line for the air-fuel ratio. The same is also applied to the broken lines.

In the embodiment, the control for performing the gradual change in the air-fuel ratio is not performed between the feedback region B and the heavy load region C. Between these regions, it is desirable to make the engine output torque change relatively abruptly. However, when desired, a similar control may be made between the regions B and C.

The invention has thus been shown and described with reference to a specific embodiment, however, it should be noted that the invention is in no way limited to the details of the illustrated embodiment but changes and modifications may be made without departing from the scope of the appended claims.

We claim:

1. An engine air-fuel ratio control system for controlling air-fuel ratio of a mixture to be supplied to the engine, said system including air-fuel ratio control means for providing a first air-fuel ratio in a first region of engine operating condition and a second air-fuel ratio in a second region of engine operating condition, engine operating condition detecting means for producing an engine operating condition signal which is applied to said air-fuel ratio control means to make the air-fuel ratio control means output a signal corresponding to one of the first and second air-fuel ratios depending on the engine operating condition, engine load change rate detecting means for detecting a rate of change in load on the engine and producing a load change rate signal, air-fuel ratio changing means responsive to said load change rate signal to determine a rate of change in the air-fuel ratio, when the engine operating condition changes between said first and second regions, in accordance with the rate of change in the engine load so that the rate of change in the air-fuel ratio is inreased as the rate of change in the engine load increases.

2. A control system in accordance with claim 1 in which said first region is a light load region and said second region is a medium load region.

3. A control system in accordance with claim 2 in which said first air-fuel ratio is leaner than a stoichiometric value and said second air-fuel ratio is of a stoichiometric value.

4. An engine air-fuel ratio control system for controlling air-fuel ratio of a mixture to be supplied to the engine to at least two different values depending on engine operating conditions, said system including engine operating condition detecting means for detecting the engine operating condition to produce an engine operating condition signal, air-fuel ratio setting means responsive to the engine operating condition signal for setting one of the values of the air-fuel ratio depending on the engine operating condition, engine load change rate detecting means for detecting a rate of change in load on the engine and producing a load change rate signal, air-fuel ratio change rate setting means responsive to said load change rate signal to determine a rate of change in the air-fuel ratio, when the air-fuel ratio is to be changed from one value to another, in accordance with the rate of change in the engine load so that the rate of change in the air-fuel ratio is increased as the rate of change in the engine load increases.

5. A control system in accordance with claim 4 in which said engine load change rate detecting means is means for detecting a rate of change in position of engine throttle valve means.

6. A control system in accordance with claim 4 in which said air-fuel ratio change rate setting means is means for determining the rate of change of the air-fuel ratio which is larger in case where the mixture is to be enriched than where the mixture to be made leaner.

7. A control system in accordance with claim 4 in which said air-fuel ratio setting means includes means for determining a basic fuel supply quantity in accordance with the engine operating condition and providing a correction factor for correcting the basic fuel supply quantity to obtain a desired air-fuel ratio.

8. A control system in accordance with claim 7 in which said air-fuel ratio change rate setting means is means for determining a rate of change of said correction factor.

9. A control system in accordance with claim 4 in which said two different values of the air-fuel ratio are those for a light load region and a medium load region, respectively, of engine operation.

10. A control system in accordance with claim 9 in which the value of the air-fuel ratio for the light load region is leaner than the stoichiometric value and the value for the medium load region is the stoichiometric value.

* * * * *